United States Patent [19]

Barna

[11] 4,056,218

[45] Nov. 1, 1977

[54] DEVICE FOR CARRYING A HANDGUN

[76] Inventor: Alex J. Barna, 1216 Crawford St., Duquesne, Pa. 15110

[21] Appl. No.: 685,272

[22] Filed: May 11, 1976

[51] Int. Cl.[2] ..... F41B 33/00

[52] U.S. Cl. ..... 224/2 C; 224/26 R; 24/3 R

[58] Field of Search ..... 224/2 C, 2 B, 2 A, 2 D, 224/2 E, 2 F, 1 R, 3, 5 A, 26 B, 26 R, 25 R, 5 R; 24/3 J, 3 L, 3 R, 3 H, 2.5, 10 R

[56] References Cited

U.S. PATENT DOCUMENTS

| | | | |
|---|---|---|---|
| 1,348,718 | 8/1920 | Hoffmann | 24/3 J UX |
| 2,320,450 | 6/1943 | Valenzuela | 224/2 C UX |

*Primary Examiner*—Robert J. Spar
*Assistant Examiner*—Jerold M. Forsberg
*Attorney, Agent, or Firm*—Stanley J. Price, Jr.; John M. Adams

[57] ABSTRACT

A device is provided for attachment to a handgun to permit releasably securing the attached handgun to an adjacent portion of body wearing apparel.

7 Claims, 6 Drawing Figures

DEVICE FOR CARRYING A HANDGUN

BACKGROUND OF THE INVENTION

1. Field of the Invention

This invention relates to means for releasably securing a handgun to an adjacent portion of body wearing apparel and, more specifically, to an accessory device for a handgun that facilitates positively securing and, if necessary, selectively positioning and/or concealing a handgun in various locations on the person of its user in a manner such that the handgun can be quickly and efficiently brought into use unencumbered by handgun carrying devices such as the conventional holster.

2. Description of the Prior Art

Holsters used for carrying handguns, whether concealed or not, on the body of a person are well known and should require no extensive description. Generally, a holster may be simply described as a carrying case for a pistol. In most common use, holsters are made of leather or like material in the form of an enlarged pocket and are generally, although not necessarily, attached to the waist or shoulder portions of the body of its user by means of a belt, on the one hand, or a shoulder strap or harness, on the other. Not infrequently a holster is additionally provided with a closure strap or flap that may be secured over the top or opening of the holster pocket and the handgrip portion of a gun carried therein in various ways, such as by means of a snap fastener. Such closure straps or flaps are provided to prevent unintentional dislodgment of the handgun from the holster, particularly in situations where the user is required to perform body movements which, with attendant gravitational or inertial forces, would dislodge or tend to dislodge the handgun from its position of securement in the holster.

Unfortunately, there are frequent instances in police, security, paramilitary, military and like or similar activity where rapid and unusual body movements are required such that the accurrence of dislodgment of a gun from its holster becomes a matter of great concern. Moreover, in such or similar activity to that mentioned above, it is sometimes desirable or necessary to remove a gun for use and resecure the gun on the body of the user at relatively frequent intervals during the course of a particular activity or engagement. In addition, it is also frequently desirable or necessary to position a handgun on another portion of the user's body, other than that provided by a prepositioned holster, while engaged in a particular activity or encounter. Accordingly, it has been found that there is a need for a handgun securing device that meets all of the exigencies of use that may be encountered in police, security or other law enforcement or military activity while avoiding the encumbrance and/or restricted versatility inherent in the use of conventional holsters.

SUMMARY OF THE INVENTION

In accordance with the present invention there is provided a device for attachment to a handgun to permit releasably securing the handgun in a variety of locations to an adjacent portion of body wearing apparel. More specifically, this invention provides a device for releasably securing a handgun in convenient positions on body wearing apparel and comprises means for mounting the device onto a handgun and means integral therewith for releasably securing the device to an adjacent portion of body wearing apparel.

The foregoing and other objects, features and advantages of this invention will become more apparent when taken with the following specification, the accompanying drawing and the appended claims.

DESCRIPTION OF PREFERRED EMBODIMENTS

Figure 1:
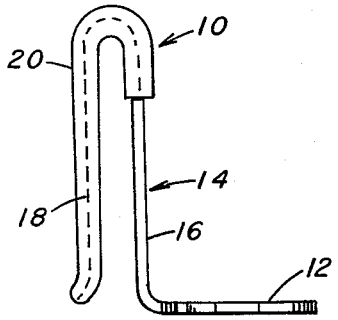
FIG. 1 is a schematic elevation of a preferred embodiment of this invention.
Figure 2:
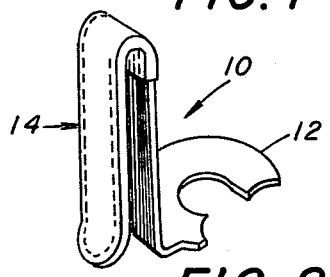
FIG. 2 is a perspective of the device shown in FIG. 1, illustrating further details of the invention.
Figure 4:
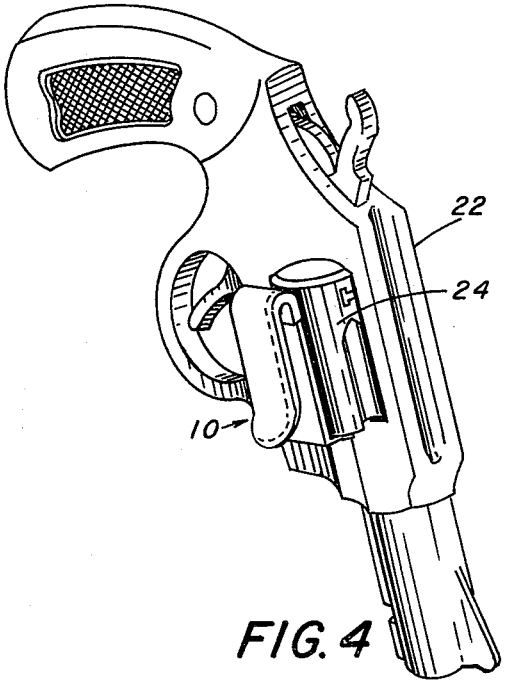
FIG. 4 is a perspective showing a revolver with the device of this invention affixed about its cylinder.

Referring to FIGS. 1 and 2, there is shown a preferred pistol clip of pistol securing device 10 of this invention. As therein illustrated, pistol securing device 10 is comprised of a handgun mounting or attachment means 12 formed integrally with a wearing apparel attachment or securement means 14 and together forming a substantially "L" shaped member in profile. As will be appreciated, wearing apparel securing means 14 may, as shown, be desirably in the form of a substantially "U" shaped member or "U" shaped clip in profile to facilitate its releasable attachment to various portions of the user's body wearing apparel. Formed integrally with one leg 16 of said "U" shaped clip 14 and extending at substantially a right angle and laterally from the free end thereof is handgun mounting or attachment means 12.

Figure 3:
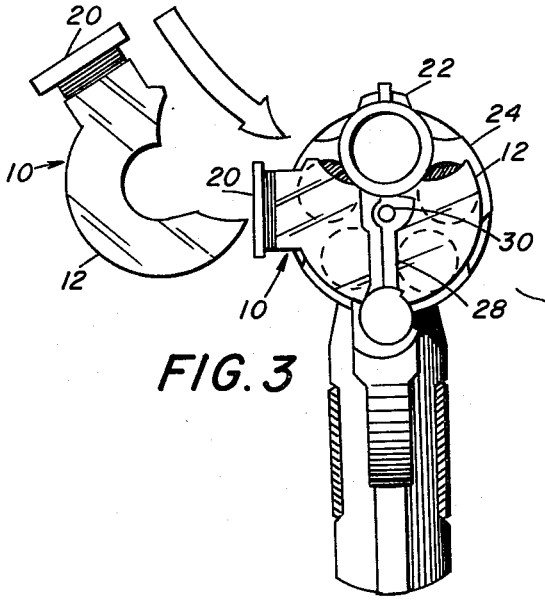
FIG. 3 is an end view of a revolver, looking into the barrel, illustrating the manner in which a device of this invention is arcuately moved into its mounted position on the revolver.

Handgun attachment means 12, as best illustrated in FIGS. 2 and 3, is shown as a substantially "C" shaped, relatively slim, flat, flange member that adjoins the free end of leg 16 adjacent the opening in "C" shaped member or clip position 12. Clip 10 is desirably formed of hardened spring metal. Moreover, to prevent body abrasion, the other leg 18 of clip portion 14 is desirably enclosed in a non-metallic covering 20 along at least the portion of its length adjacent its free end and, more preferably, along its total length and even a limited portion therebeyond.

Figure 5:
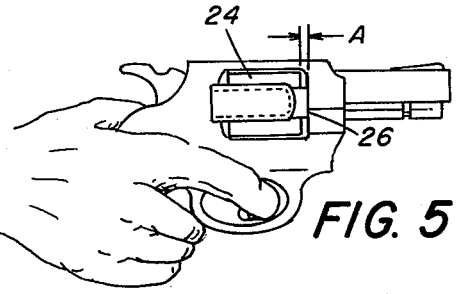
FIG. 5 is a side view of a revolver carrying the novel pistol clip on this invention.

As best shown in FIGS. 3 and 5, the clip 10 is specifically designed to be attached to a revolver 22. In this regard, several criteria have been incorporated into clip 10, fundamental of which is the provision of a design for "C" member 12 that permits it to be inserted into the void zone A between the forward end of cylinder 24 and the forward surface portions 26 of the opening housing cylinder 24, without interfering with the operation of revolver 22. In this connection, the opening in "C" member 12 is of a size and shape adequate to leave the active chamber of cylinder 24 unobstructed and, additionally, during installation to permit "C" member 12 to freely pass around cylinder components such as the hinge member 28 housing cylinder axle 30. The inner arcuate portion of the "C" member engages the axle 30 in the void or opening "A" to attach and retain the clip 10 onto the revolver 22. In addition to the foregoing, covering 20 is desirably extended from leg 18 continuously onto leg 16 to provide therewith slight frictional engagement with rear portions of cylinder 24 for the purpose of aiding in stabilizing clip 10 in its desired position on revolver 22. Moreover, in the embodiment shown wherein cylinder 24 pivots to the user's left for loading and unloading and clip 10 is, as viewed by the user, on the right side of the gun, it is important that the "U" portion 14 of clip 10 be no greater in length than the unobstructed opening provided in its path when cylinder 24 is pivoted for loading or unloading.

Figure 6:
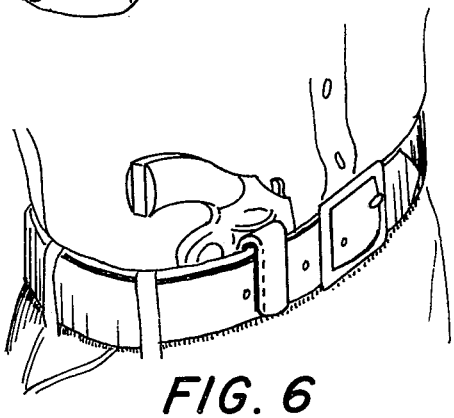
FIG. 6 is an illustrative view showing one manner of attachment of a handgun to body wearing apparel in accordance with this invention.

FIG. 6 is a view showing the use of a device of this invention to secure a revolver to the right-front of a waist belt. It will be apparent, however, that other positions on the waist belt, such as the left-front, either side or the left-center or right-rear of the belt present alternative positions for securing the revolver. Moreover, other portions of body wearing apparel, such as boot tops, pockets, shirt fronts, collars jacket sleeves and the like present possible alternatives to locations for securing a gun, particularly where concealment or surprise are an essential element in the gun's use. In addition, it will be apparent that modifications of the specific embodiment of this invention illustrated will occur to those skilled in the art. For example, for revolver cylinders that pivot to the same side as the clip mounting position for loading or unloading and for revolvers that have a hinged barrel, in lieu of a pivoting cylinder, the length of "U" portion 14 is of no especial consequence. Furthermore, it will be apparent to those skilled in the art that the principals of this invention may also be adapted for use in connection with other handguns than the revolver shown such as, for example, an automatic pistol suitably provided with adaptive means for mounting a clip similar to clip 10. Accordingly, it should be understood that, within the scope of the appended claims, the invention may be practiced otherwise than as illustrated and described.

I claim:

1. A device for releasably securing a handgun to body wearing apparel comprising, a shaped member having a pair of leg portions adapted for releasable engagement to body wearing apparel, attachment means formed integral with and extending laterally from the end of one of said leg portions for releasably engaging the handgun, said attachment means including a single "C" shaped portion having an opening transverse to the longitudinal axis of said leg portions, said "C" shaped portion arranged to receive the body of the handgun to facilitate installation of said shaped member while the handgun is in operation, and stabilizing means covering a portion of one of said leg portions for frictionally engaging the body of the handgun for maintaining said shaped member in position on the handgun.

2. A device for releasably securing a handgun to body wearing apparel comprising, a "U" shaped clip having a pair of leg portions joined adjacent one end thereof and maintained in spaced relation for releasably securing said clip to an adjacent portion of body wearing apparel, a single "C" shaped portion formed integral with said clip and having an opening transverse to the longitudinal axis of said leg portions, said opening of said "C" shaped portion arranged to receive the body of the handgun to facilitate movement of said clip into and out of mounting position on the handgun without obstructing operation thereof, and stabilizing means covering a portion of one of said leg portions for functionally engaging the body of the handgun for maintaining said device in position on the handgun.

3. A device according to claim 1 wherein said "C" shaped portion is secured to a free end of one of said leg portions and extending at a right angle thereto to form a substantially "L" shaped member in profile.

4. A device according to claim 1 wherein said leg portions are connected at an adjacent end portion to form a "U" shaped clip portion for receiving a selected portion of body wearing apparel.

5. A device according to claim 4 wherein said "C" shaped portion extends laterally of one of said leg portions of said "U" shaped clip portion adjacent the free end thereof.

6. A device according to claim 1 in which said stabilizing means includes a nonmetallic covering along at least part of the other leg of said "U" shaped clip portion such that when said attachment means engages the body of the handgun said covering frictionally engages the body of the handgun to maintain said device thereon.

7. A device according to claim 5 wherein said "C" shaped portion includes a relatively thin, flat flange member extending from one of said leg portions of said "U" shaped clip portion and adjoining said clip portion adjacent said opening of said "C" shaped portion.

* * * * *